US010760177B2

(12) United States Patent
Masuda et al.

(10) Patent No.: US 10,760,177 B2
(45) Date of Patent: Sep. 1, 2020

(54) PLATING METHOD, PLATING APPARATUS, AND METHOD FOR ESTIMATING LIMITING CURRENT DENSITY

(71) Applicant: EBARA CORPORATION, Tokyo (JP)

(72) Inventors: Yasuyuki Masuda, Tokyo (JP); Masashi Shimoyama, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 16/426,079

(22) Filed: May 30, 2019

(65) Prior Publication Data

US 2019/0368069 A1 Dec. 5, 2019

(30) Foreign Application Priority Data

Jun. 5, 2018 (JP) ..... 2018-107541

(51) Int. Cl.
*C25D 21/12* (2006.01)
*C25D 7/12* (2006.01)
*C25D 17/00* (2006.01)

(52) U.S. Cl.
CPC ..... *C25D 21/12* (2013.01); *C25D 7/123* (2013.01); *C25D 17/001* (2013.01)

(58) Field of Classification Search
CPC . C25D 17/001; C25D 7/12–123; C25D 21/12
See application file for complete search history.

(56) References Cited

U.S. PATENT DOCUMENTS

2004/0262150 A1 12/2004 Yajima et al.
2006/0183257 A1* 8/2006 Okubo ..... G01N 27/42 438/17
2014/0367279 A1* 12/2014 Brogan ..... G01N 27/413 205/794
2015/0203983 A1* 7/2015 Tamari ..... C25D 21/14 205/83
2016/0298256 A1* 10/2016 Thorum ..... C25D 7/12
2017/0342590 A1* 11/2017 Thorkelsson ..... C25D 21/10

FOREIGN PATENT DOCUMENTS

WO 2004/009879 A1 1/2004

* cited by examiner

*Primary Examiner* — Brian W Cohen
*Assistant Examiner* — Ho-Sung Chung
(74) *Attorney, Agent, or Firm* — Rothwell, Figg, Ernst & Manbeck, P.C.

(57) ABSTRACT

A plating method for plating a substrate by increasing a current value from a predetermined current value to a first current value is provided. The plating method plates the substrate for a first predetermined period with the first current value when a first current density corresponding to the first current value is lower than a limiting current density. This plating method includes measuring a voltage value applied to the substrate, and when the current value is increased from the predetermined current value to the first current value, determining whether the first current density is equal to or more than the limiting current density or not based on an amount of change in the voltage value.

6 Claims, 5 Drawing Sheets

PLATING METHOD, PLATING APPARATUS, AND METHOD FOR ESTIMATING LIMITING CURRENT DENSITY

CROSS-REFERENCE TO RELATED APPLICATION

This application is based upon and claims benefit of priority from Japanese Patent Application No. 2018-107541 filed on Jun. 5, 2018, the entire contents of which are incorporated herein by reference.

TECHNICAL FIELD

The present invention relates to a plating method, a plating apparatus, and a method for estimating a limiting current density.

BACKGROUND ART

As an electroplating apparatus employing what is called a dip method, an electroplating apparatus that includes a plating bath, which internally houses a plating solution, a substrate and an anode, which are arranged as opposed to one another inside the plating bath, and a regulation plate, which is arranged between the anode and the substrate, has been known (for example, see PTL 1). This electroplating apparatus includes a paddle to stir the plating solution between the regulation plate and the substrate. The paddle moves in a reciprocating direction along a surface of the substrate to stir the plating solution near the substrate surface.

Recently, to improve a productivity of a plating apparatus, it has been required to reduce a plating period required for forming a plating film having a predetermined film thickness. To perform plating having the predetermined film thickness in a shorter time on a certain plating area, it is necessary to perform the plating with a high current density. In the plating apparatus described in PTL 1, moving the paddle at high speed facilitates supply of metal ions to the substrate surface, thus suppressing reduction in quality of the plating when the plating is performed with the high current density.

CITATION LIST

Patent Literature

PTL 1: WO2004/009879

SUMMARY OF INVENTION

Technical Problem

In the plating apparatus, increase in the current density applied to the substrate causes shortage of the supply of the metal ions to the substrate surface when the current density exceeds a predetermined current density. The current density at this time is referred to as a limiting current density. When the plating is performed for a predetermined period with the current density exceeding the limiting current density, abnormal deposition occurs on a plating surface.

To reduce the plating period, it is necessary to perform the plating with the current density as close as possible to the limiting current density. It has been found that the limiting current density gradually increases as the metal deposits on the substrate. In view of this, in the plating apparatus, the plating is performed by increasing the current density in phases. Conventionally, the substrate has been actually plated for a predetermined period to examine the current density with which the abnormal deposition does not occur on the substrate preliminarily in a test. This has controlled the plating apparatus so that the current density applied to the substrate is less than the limiting current density.

However, while the substrate is actually being plated in the plating apparatus, there has been a possibility that the limiting current density becomes lower than expected due to a density change of the plating solution, a finishing accuracy of the substrate, operation error by a worker, and the like to cause the current density applied to the substrate to exceed the limiting current density. Conventionally, when such a situation has occurred, it has been possible to confirm the occurrence of the abnormal deposition on the substrate in an inspection process of the substrate after plating. Accordingly, there has been a possibility that a plurality of substrates are plated with the current density exceeding the limiting current density until the substrate is inspected.

The present invention has been made in consideration of the above-described problems, and one object of the present invention is to know whether a current density is equal to or more than a limiting current density or not during plating.

Solution to Problem

According to one aspect of the present invention, a plating method is provided. The plating method increases a current value from a predetermined current value to a first current value, and plates the substrate for a first predetermined period with the first current value when a first current density corresponding to the first current value is lower than a limiting current density. The plating method includes measuring a voltage value applied to the substrate, and when the current value is increased from the predetermined current value to the first current value, determining whether the first current density is equal to or more than the limiting current density or not based on an amount of change in the voltage value.

According to another aspect of the present invention, a plating apparatus that plates a substrate by increasing a current value from a predetermined current value to a first current value is provided. This plating apparatus includes a plating bath configured to house a plating solution, a power supply that applies a current to the substrate, and a current control unit that controls the current to the substrate. The current control unit includes a voltage measuring unit that measures a voltage value applied to the substrate, and a determining unit that, when the current value is increased from the predetermined current value to the first current value, determines whether a first current density corresponding to the first current value is equal to or more than a limiting current density or not based on an amount of change in the voltage value. The current control unit controls the power supply to apply the current to the substrate for a first predetermined period with the first current value when the first current density is lower than the limiting current density.

According to another aspect of the present invention, a method for estimating a limiting current density in a plating apparatus that plates a substrate is provided. This method includes increasing a current density of a current applied to the substrate, measuring a voltage value applied to the substrate, and when the voltage value has increased by a predetermined value within a predetermined period, determining that the current density is equal to or more than the limiting current density.

DESCRIPTION OF EMBODIMENTS

First Embodiment

Figure 1:
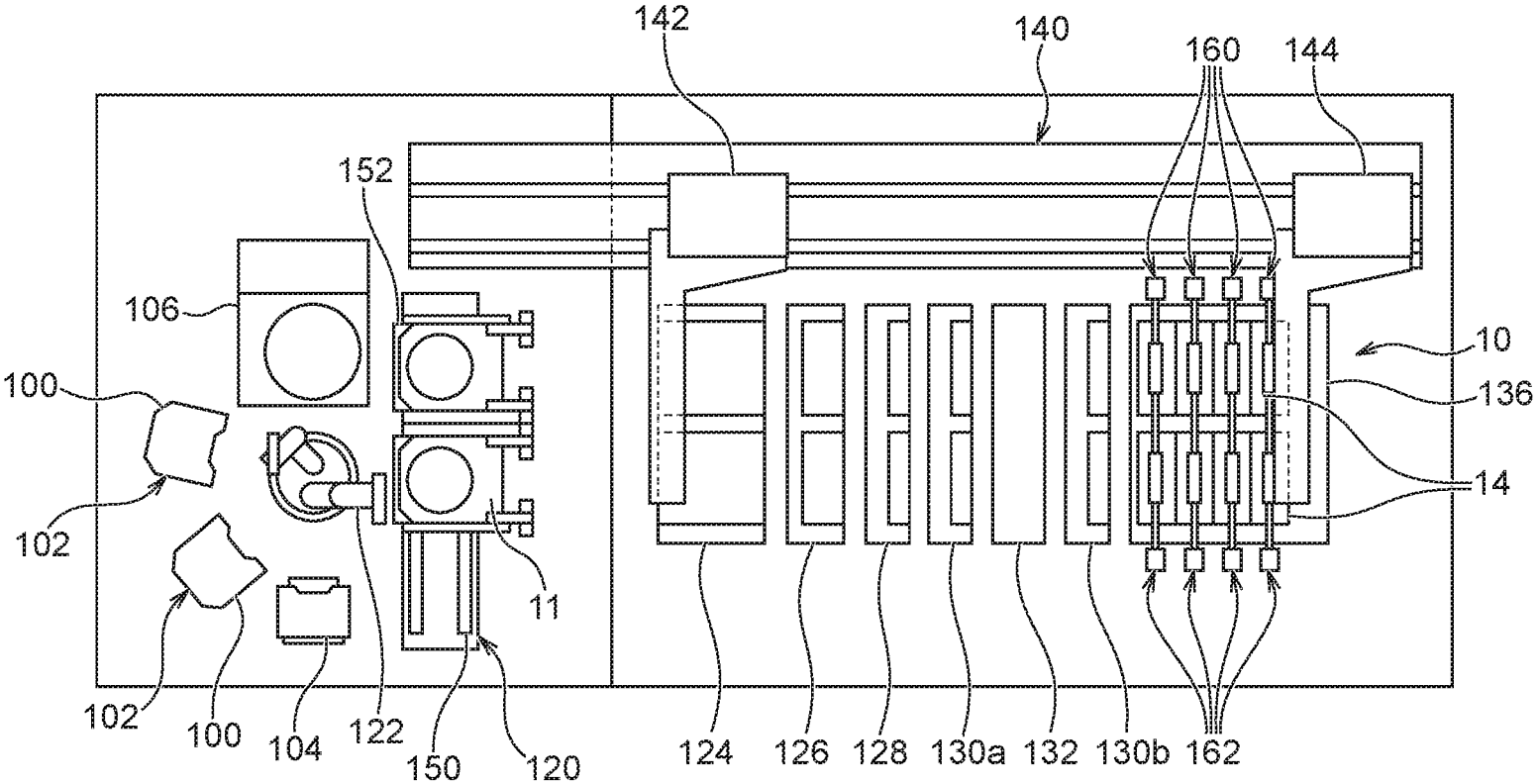
FIG. 1 is an entire layout drawing of a plating apparatus according to a first embodiment.

The following describes a first embodiment with reference to the drawings. In the drawings described later, the identical reference numerals are used for the identical or equivalent components, and therefore such components will not be further elaborated here. FIG. 1 is an entire layout drawing of a plating apparatus according to the first embodiment. As illustrated in FIG. 1, this plating apparatus includes two cassette tables 102, an aligner 104, and a spin rinse dryer 106. The aligner 104 is configured to adjust positions of an orientation flat, a notch, and the like of a substrate in a predetermined direction. The spin rinse dryer 106 is configured to rotate the substrate after a plating process at high speed to dry it.

The cassette table 102 mounts a cassette 100 storing a substrate such as a semiconductor wafer. A substrate attaching and removing portion 120 on which a substrate holder 11 is placed to attach and remove the substrate is disposed near the spin rinse dryer 106. The substrate attaching and removing portion 120 includes a tabular placing plate 152 slidable in a lateral direction along a rail 150. Two substrate holders 11 are placed in parallel on this placing plate 152 in a horizontal state. After delivery of the substrate is performed between one substrate holder 11 and a substrate conveying device 122, the placing plate 152 is slid in the lateral direction, and then, the delivery of the substrate is performed between the other substrate holder 11 and the substrate conveying device 122. At a center of these units 100, 104, 106, and 120, the substrate conveying device 122 formed of a robot for conveyance that conveys the substrate between these units is arranged.

The plating apparatus further includes a stocker 124, a pre-wet bath 126, a pre-soak bath 128, a first cleaning bath 130*a*, a blow bath 132, a second cleaning bath 130*b*, and a plating unit 10. In the stocker 124, the substrate holder 11 is stored and temporarily placed. In the pre-wet bath 126, the substrate is immersed in a pure water. In the pre-soak bath 128, an oxide film on a surface of a conducting layer such as a seed layer formed on a surface of the substrate is removed by etching. In the first cleaning bath 130*a*, the substrate after pre-soak is cleaned with a cleaning liquid (for example, a pure water) together with the substrate holder 11. In the blow bath 132, liquid draining is performed on the substrate after cleaning. In the second cleaning bath 130*b*, the substrate after plating is cleaned with a cleaning liquid together with the substrate holder 11. The substrate attaching and removing portion 120, the stocker 124, the pre-wet bath 126, the pre-soak bath 128, the first cleaning bath 130*a*, the blow bath 132, the second cleaning bath 130*b*, and the plating unit 10 are arranged in this order.

The plating unit 10 is configured, for example, such that an overflow bath 136 surrounds an outer periphery of a plurality of adjacent plating baths 14. Each plating bath 14 is configured to internally house one substrate and immerse the substrate in a plating solution internally held to perform the plating such as copper plating on the substrate surface.

The plating apparatus includes a substrate holder conveyance device 140 that employs, for example, a linear motor system. The substrate holder conveyance device 140 is positioned lateral to these respective devices to convey the substrate holder 11 together with the substrate between these respective devices. This substrate holder conveyance device 140 includes a first transporter 142 and a second transporter 144. The first transporter 142 is configured to convey the substrate between the substrate attaching and removing portion 120, the stocker 124, the pre-wet bath 126, the pre-soak bath 128, the first cleaning bath 130*a*, and the blow bath 132. The second transporter 144 is configured to convey the substrate between the first cleaning bath 130*a*, the second cleaning bath 130*b*, the blow bath 132, and the plating unit 10. The plating apparatus may include only the first transporter 142 without including the second transporter 144.

Paddle driving portions 162 and paddle driven portions 160 that drive paddles 16 (see FIG. 3) positioned inside the respective plating baths 14 to stir the plating solution in the plating baths 14 as stirring rods are arranged on both sides of the overflow bath 136.

Figure 2:
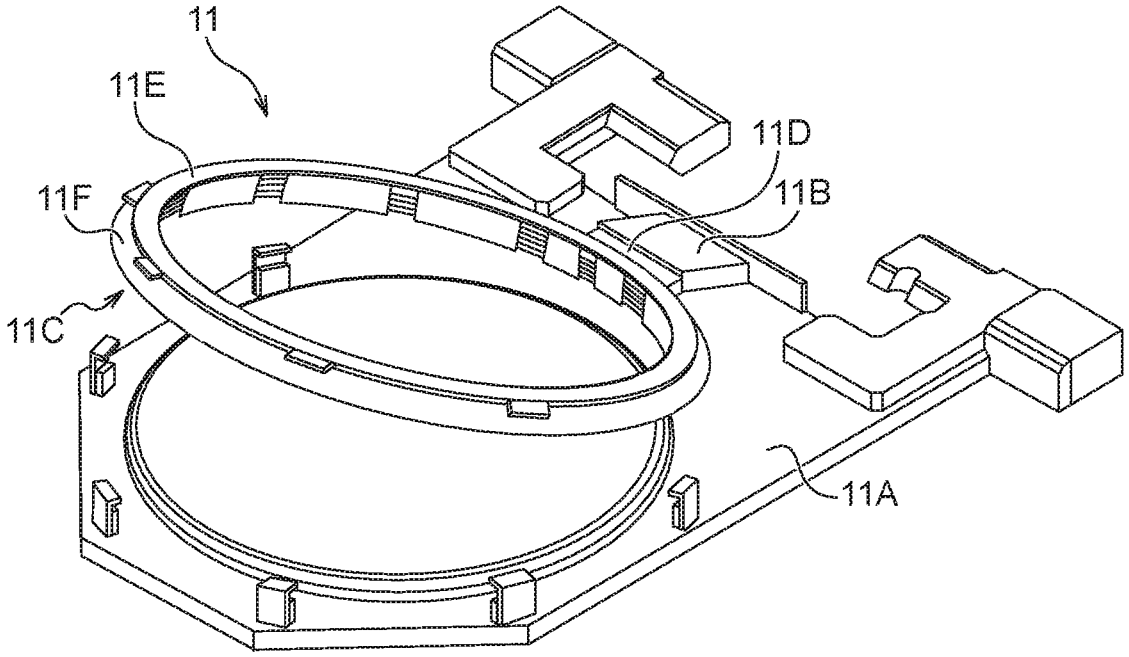
FIG. 2 is a schematic perspective view of a substrate holder illustrated in FIG. 1.

FIG. 2 is a schematic perspective view of the substrate holder 11 illustrated in FIG. 1. As illustrated in FIG. 2, the substrate holder 11 includes an approximately tabular first holding member 11A made of, for example, vinyl chloride and a second holding member 11C mounted openably/closably on this first holding member 11A via a hinge portion 11B. The second holding member 11C includes a base portion 11D connected to the hinge portion 11B, a pressing ring 11F to press the substrate to the first holding member 11A, and a ring-shaped seal holder 11E. The seal holder 11E is configured slidable to the pressing ring 11F. This seal holder 11E is made of, for example, vinyl chloride. This improves slippage with the pressing ring 11F. In this embodiment, the plating apparatus is described as one that processes a circular substrate such as a wafer, but it is not limited to this. The plating apparatus can also process a rectangular substrate.

Figure 3:
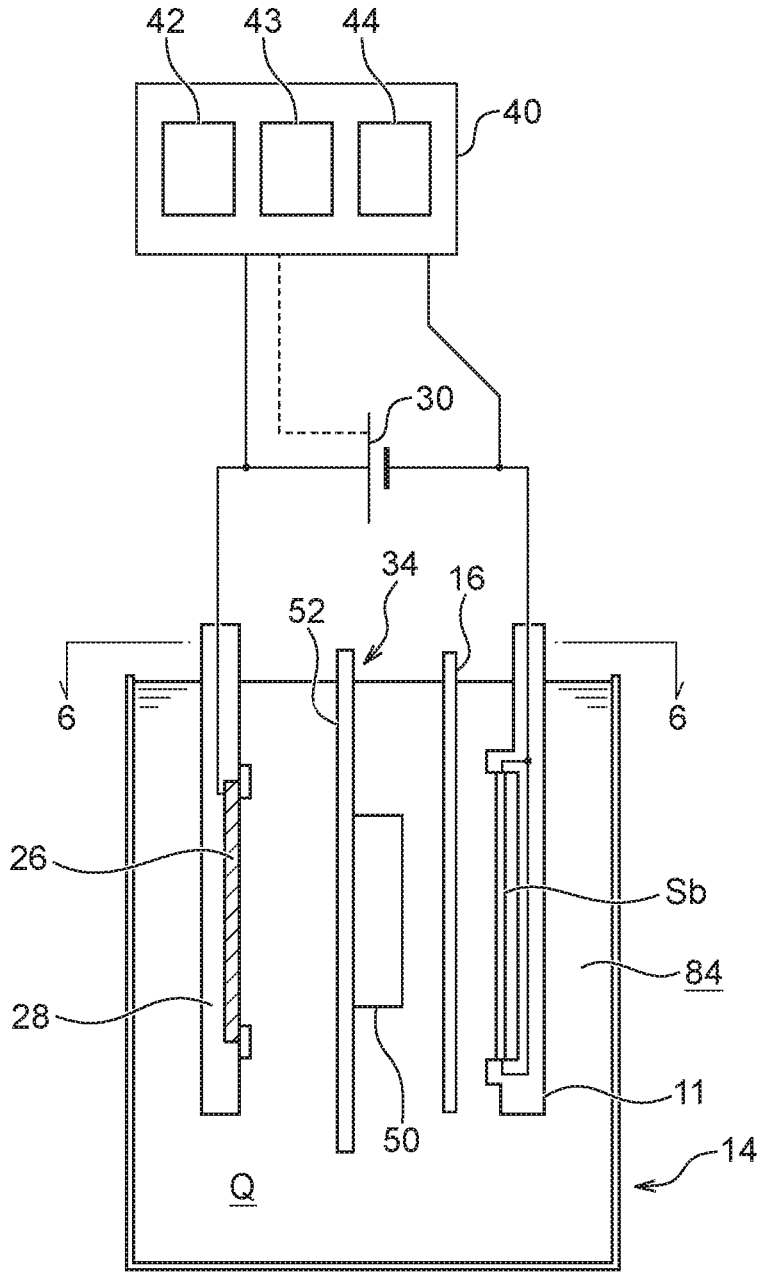
FIG. 3 is a schematic longitudinal sectional view illustrating one plating bath of a plating unit illustrated in FIG. 1.

FIG. 3 is a schematic longitudinal sectional view illustrating one plating bath 14 of the plating unit 10 illustrated in FIG. 1. In the drawing, the overflow bath 136 is omitted. The plating bath 14 is configured to internally hold a plating solution Q to circulate the plating solution Q with the overflow bath 136.

The plating bath 14 houses the substrate holder 11 that attachably/removably holds a substrate Sb. The substrate holder 11 is arranged in the plating bath 14 so that the substrate Sb is immersed in the plating solution Q in a vertical state. An anode 26 held onto an anode holder 28 is arranged on a position facing the substrate Sb in the plating bath 14. As the anode 26, for example, a soluble anode made of phosphorus-containing copper or a known insoluble anode can be used. A plating power supply 30 (equivalent to an exemplary power supply) configured to apply current to the substrate Sb and the anode 26 is disposed on the plating bath 14. The substrate Sb is electrically connected to the anode 26 via the plating power supply 30. Applying the current between the substrate Sb and the anode 26 forms a plating film (a copper film) on a surface of the substrate Sb.

The paddle 16 reciprocated parallel to the surface of the substrate Sb to stir the plating solution Q is arranged between the substrate Sb and the anode 26. Stirring the plating solution Q with the paddle 16 can uniformly supply the surface of the substrate Sb with copper ions. A regulation plate 34 formed of a dielectric material to more equalize an electric potential distribution over the whole surface of the substrate Sb is arranged between the paddle 16 and the anode 26. The regulation plate 34 has a plate-shaped main body 52 having an opening and a tubular portion 50 mounted along the opening of the main body 52. The electric potential distribution between the anode 26 and the substrate Sb is adjusted depending on a magnitude and a shape of the opening of the regulation plate 34.

A current control unit 40 that controls the plating power supply 30 to control the current to the substrate Sb is disposed on the plating bath 14. The current control unit 40 includes a voltage measuring unit 42, a notification unit 43, and a determining unit 44. The voltage measuring unit 42 is configured to measure a voltage value applied to the substrate Sb. The notification unit 43 is configured to notify a user or an administrator of predetermined information with light, sound, vibration, screen display, and the like. The determining unit 44 determines whether a current density of the current applied to the substrate Sb is equal to or more than a limiting current density or not based on the voltage value measured by the voltage measuring unit 42 as described later.

The following describes a plating method in the plating apparatus according to the first embodiment. As described above, in the plating apparatus, the plating is performed by increasing the current density in phases. However, while the substrate is actually being plated in the plating apparatus, there has been a possibility that the limiting current density becomes lower than expected due to a density change of the plating solution, a finishing accuracy of the substrate Sb, operation error by a worker, and the like to cause the current density applied to the substrate Sb to exceed the limiting current density.

Incidentally, it has been found that, when the current density applied to the substrate Sb has reached the limiting current density, a value of the voltage applied to the substrate Sb rapidly increases. Therefore, in this embodiment, the determining unit 44 of the current control unit 40 determines whether the current density of the current applied to the substrate Sb is equal to or more than the limiting current density or not based on the voltage value applied to the substrate Sb. More specifically, preliminarily in a test, a degree of increase in the voltage value for a predetermined period in a case where an abnormality occurs on the substrate Sb when being plated in a state where the current density has been increased (a case where the current density has reached the limiting current density) has been obtained. In this embodiment, for example, it is assumed that it has been proved that, in the test, in the case where the current density has reached the limiting current density, the voltage value has changed by 0.3 V (a predetermined value) or more within 15 seconds (the predetermined period) from a change of the current value by the current control unit 40. In this case, the determining unit 44 determines whether the current density has reached the limiting current density or not based on whether the voltage value has increased by 0.3 V or more within 15 seconds from the change of the current value or not. This voltage value as a threshold needs to be determined as necessary by the test since it may vary depending on a pattern of the substrate Sb, the current density, a composition of the plating solution, and the like.

Figure 4:
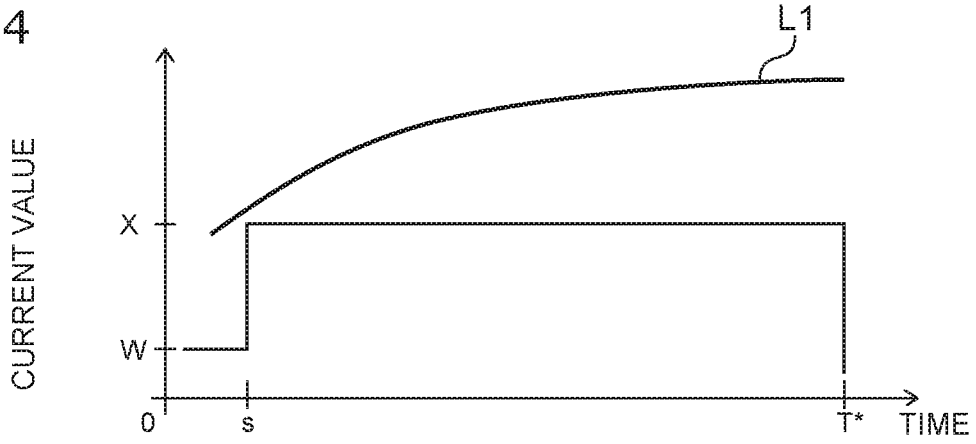
FIG. 4 is a graph illustrating an exemplary current control in the plating apparatus according to the first embodiment.

FIG. 4 is a graph illustrating an exemplary current control in the plating apparatus according to the first embodiment. In the graph in the drawing, the horizontal axis indicates a time, and the vertical axis indicates a current value. In the graph in the drawing, for convenience, a curved line L1 that indicates a virtual limiting current value is noted. The limiting current value here means a current value corresponding to the limiting current density.

As illustrated in the drawing, the current control unit 40 of this plating apparatus controls the plating power supply 30 to increase the current value to a value X (equivalent to an exemplary first current value) in phases at a time point of a time s after performing the plating with the current value of a value W. Here, the value X is smaller than a value at the time point of the time s of the curved line L1 indicating the limiting current value. Accordingly, the voltage measuring unit 42 detects that an increased amount of the voltage value within 15 seconds from the increase in the current value to the value X is less than 0.3 V. The determining unit 44 determines that the current density (equivalent to an exemplary first current density) corresponding to the value X is less than the limiting current density based on the voltage value measured by the voltage measuring unit 42. As a result, the current control unit 40 controls the plating power supply 30 to plate the substrate Sb for a predetermined period (equivalent to an exemplary first predetermined period) from the time s to a time T* with the value X. In the example in the drawing, the plating is ended at the time point of the time T* by setting the current value at 0, but it is not limited to this. The plating may be continued by further increasing the current value in phases at the time point of the time T*.

Figure 5:
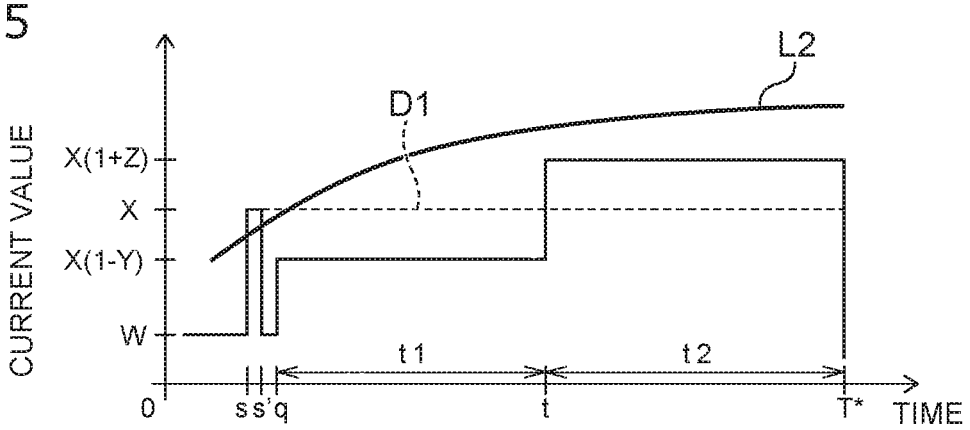
FIG. 5 is a graph illustrating another exemplary current control in the plating apparatus according to the first embodiment.

FIG. 5 is a graph illustrating another exemplary current control in the plating apparatus according to the first embodiment. In the graph in the drawing, the horizontal axis indicates a time, and the vertical axis indicates a current value. In FIG. 5, a solid line indicates the current control in this example, and a dashed line D1 indicates the current control illustrated in FIG. 4. As in the drawing, the current control unit 40 controls the plating power supply 30 to increase the current value to the value X (equivalent to an exemplary first current value) in phases at the time point of the time s after performing the plating with the current value of the value W. Here, the value X is greater than a value at the time point of the time s of a curved line L2 indicating the limiting current value. Accordingly, the voltage measuring unit 42 detects that the increased amount of the voltage value within 15 seconds from the increase in the current value to the value X is 0.3 V or more. The determining unit 44 determines that the current density (equivalent to an exemplary first current density) corresponding to the current value of the value X is equal to or more than the limiting current density based on the voltage value measured by the voltage measuring unit 42.

The current control unit 40 reduces the current value to less than the limiting current value at the time point of a time s' when it is determined that the current density corresponding to the current value of the value X is equal to or more than the limiting current density. Here, an accurate value of the limiting current value is unknown. Thus, as illustrated in the drawing, reducing the current value to the value W surely allows the current value to be less than the limiting current value.

In this embodiment, the determining unit 44 can determine that the current density corresponding to the current value of the value X is equal to or more than the limiting current density at the time point when the voltage value has increased by 0.3 V. Accordingly, a period from the time s to the time s' is a period taken for the current value to increase by 0.3 V and within 15 seconds. At this time, in the plating apparatus of this embodiment, the substrate Sb will be plated with the current density exceeding the limiting current density between the time s and the time s'. In view of this, preliminarily in the test, it is necessary to confirm that the abnormality does not occur on the substrate Sb such that the current value is increased from the value W to the value X and the substrate Sb is plated for a period equivalent to from the time s to the time s' (15 seconds at a maximum) with the current value of the value X. Provisionally when the abnormality occurred on the substrate Sb, it is only necessary to modify thresholds (the time and the voltage value) to determine whether the current density has exceeded the limiting current density or not as necessary.

The current control unit 40 reduces the current value to the value W and then performs the plating by maintaining the value W for a predetermined period (equivalent to an exemplary fourth predetermined period). That is, the current control unit 40 performs the plating by the time point of a time q with the value W. The predetermined period (a period from the time s' to the time q) at this time is a period required for the voltage value applied to the substrate Sb to return to the voltage value applied to the substrate Sb immediately before the current value increases to the value X at the time point of the time s. That is, the substrate Sb is plated with the current value of the value W again until the voltage value applied to the substrate Sb returns to an original state.

Subsequently, the current control unit 40 increases the current value from the value W to a value X(1−Y) (equivalent to an exemplary second current value) smaller than the value X at the time point of the time q. Afterwards, after a lapse of a further predetermined period t1 (equivalent to an exemplary second predetermined period), the plating is performed for a predetermined period t2 (equivalent to an exemplary third predetermined period) with a value X(1+Z) (equivalent to an exemplary third current value) greater than the value X. A time t is a time point when the period t1 has passed from the time q. At the time T*, the current control unit 40 sets the current value from the value X(1+Z) to 0 to end the plating.

Here, a period (t1+t2) is equivalent to a period from the time q to the time T*. A value Y and a value Z are any positive numbers preliminarily determined in the test. The value Y is less than one. In the example in the drawing, the value X(1−Y) and the value X(1+Z) are values lower than the limiting current value. That is, the current density corresponding to the current value of the value X(1−Y) (equivalent to an exemplary second current density) and the current density corresponding to the current value of the value X(1+Z) (equivalent to an exemplary third current density) are lower than the limiting current density.

The current control unit 40 calculates the predetermined period t1 and the predetermined period t2 at the time point of the time q. Specifically, the predetermined period t1 and the predetermined period t2 are set so that a coulomb amount provided to the substrate Sb when the plating is performed for a predetermined period (a period from the time s to the time T*) with the current value of the value X and the coulomb amount provided to the substrate Sb from the time s to the time T* with the current value illustrated in FIG. 5 are identical. In the example in the drawing, the coulomb amount provided to the substrate Sb from the time s to the time T* is equivalent to the coulomb amount when each of the platings is performed for the period from the time s to the time s' with the current value of the value X, for the period from the time s' to the time q with the current value of the value W, for the predetermined period t1 with the current value of the value X(1−Y), and for the predetermined period t2 with the current value of the value X(1+Z).

As described above, in the example illustrated in FIG. 5, the value X is exceeding the limiting current value at the time point of the time s. In view of this, instead of the plating for the period from the time s to the time T* with the current value of the value X, the plating is performed for the predetermined period t1 with the value X(1−Y) smaller than the value X, and thereafter, the plating is performed for the predetermined period t2 with the value X(1+Z) greater than the value X. This can continue the plating process without the current value exceeding the limiting current value.

In this embodiment, the predetermined period t1 and the predetermined period t2 are set as described above. In view of this, product substrates having a close quality can be obtained while maintaining an identical plating film thickness for an identical plating period, compared with the case where the plating is performed for the period from the time s to the time T* with the current value of the value X, which is the plating process illustrated in FIG. 4.

In the example illustrated in FIG. 5, when it is determined that the current value has exceeded the limiting current value, the plating process is continued by changing the current value. However, when it is determined that the current value has exceeded the limiting current value, instead of continuing the plating process, or in addition to this, the notification unit 43 of the current control unit 40 may notify the user or the administrator of this fact.

Figure 6:
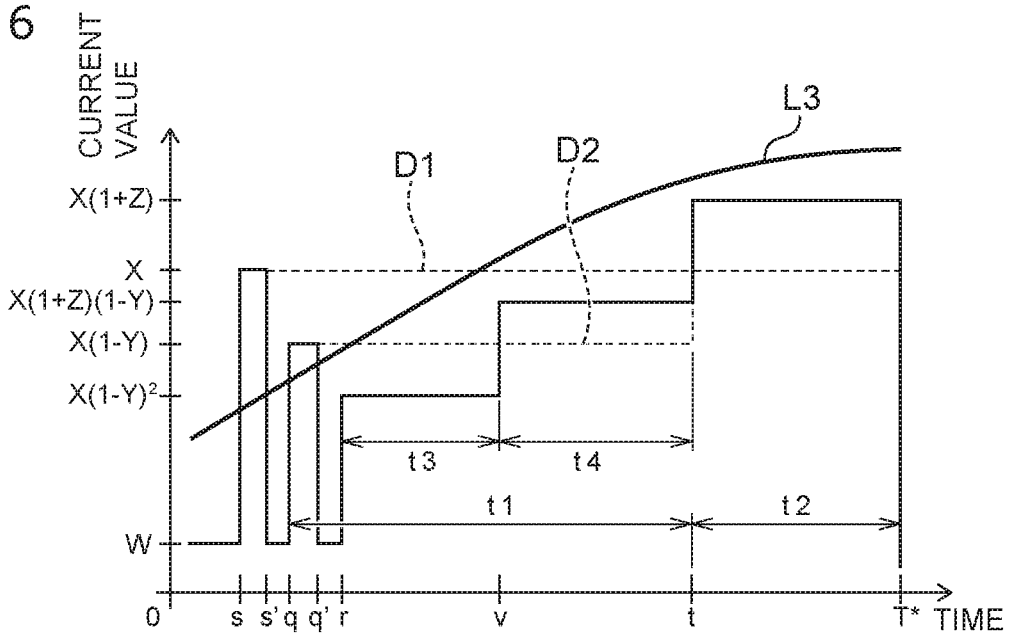
FIG. 6 is a graph illustrating another exemplary current control in the plating apparatus according to the first embodiment.

FIG. 6 is a graph illustrating another exemplary current control in the plating apparatus according to the first embodiment. In the graph in the drawing, the horizontal axis indicates a time, and the vertical axis indicates a current value. In FIG. 6, a solid line indicates the current control in this example, a dashed line D1 indicates the current control illustrated in FIG. 4, and a dashed line D2 indicates the current control illustrated in FIG. 5. In the example in FIG. 6, the current control identical to that in example in FIG. 5 is performed by the time q, thus omitting the description. The current control unit 40 increases the current value from the value W to the value X(1−Y) (equivalent to an exemplary first current value) smaller than the value X at the time point of the time q. Here, the value X(1−Y) is greater than a value at the time q of a curved line L3 indicating the limiting current value. The determining unit 44 determines that the current density corresponding to the current value of the value X(1−Y) (equivalent to an exemplary first current density) is equal to or more than the limiting current density based on the voltage value measured by the voltage measuring unit 42.

The current control unit 40 reduces the current value to less than the limiting current value (in the example in the drawing, the value W) at the time point of a time q' when it is determined that the current density corresponding to the current value of the value X(1−Y) is equal to or more than the limiting current density. A period from the time q to the time q' is a period taken for the voltage value to increase by 0.3 V and within 15 seconds. At this time, in the plating apparatus of this embodiment, the substrate Sb will be plated with the current density exceeding the limiting current density between the time q and the time q'. Here, the current value X(1−Y) is smaller than the value X. Thus, insofar as it can be confirmed that the abnormality does not occur on the substrate Sb even if the substrate Sb is plated for the period equivalent to from the time s to the time s' (15 seconds at a maximum) with the current value of the value X, the abnormality does not occur on the substrate Sb by the plating for the period from the time q to the time q' (15 seconds at a maximum).

The current control unit 40 reduces the current value to the value W at the time q' and then performs the plating by maintaining the value W for a predetermined period (equivalent to an exemplary fourth predetermined period). That is, the current control unit 40 performs the plating by a time r with the current value of the value W. The predetermined period (a period from the time q' to the time r) at this time is a period required for the voltage value applied to the substrate Sb to return to the voltage value applied to the substrate Sb immediately before the current value increases to the value X(1−Y) at the time point of the time q. That is, the substrate Sb is plated with the current value of the value W again until the voltage value applied to the substrate Sb returns to the original state.

Subsequently, the current control unit 40 increases the current value from the value W to a value $X(1-Y)^{\wedge 2}$ (equivalent to an exemplary second current value) smaller than the value X(1−Y) at the time point of the time r. Afterwards, after a lapse of a further predetermined period t3 (equivalent to an exemplary second predetermined period), the plating is performed for a predetermined period t4 (equivalent to an exemplary third predetermined period) with a value X(1+Z)(1−Y) (equivalent to an exemplary third current value) greater than the value X(1−Y). A time v is a time point when the period t3 has passed from the time r. At the time t, the current control unit 40 sets the current value from the value X(1+Z)(1−Y) to the value X(1+Z) and continues the plating only for the period t2, thus ending the plating at the time T*.

Here, a period (t3+t4) is equivalent to a period from the time r to the time t. In the example in the drawing, the value $X(1-Y)^{\wedge 2}$ and the value X(1+Z)(1−Y) are values lower than the limiting current value. That is, the current density corresponding to the current value of the value $X(1-Y)^{\wedge 2}$ (equivalent to an exemplary second current density) and the current density corresponding to the current value of the value X(1+Z)(1−Y) (equivalent to an exemplary third current density) are lower than the limiting current density.

The current control unit 40 calculates the predetermined period t3 and the predetermined period t4 at the time point of the time r. Specifically, the predetermined period t3 and the predetermined period t4 are set so that the coulomb amount provided to the substrate Sb when the plating is performed for a predetermined period (the period t1) with the current value of the value X(1−Y) and the coulomb amount provided to the substrate Sb from the time q to the time t with the current value indicated by the solid line in FIG. 6 are identical. In the example in the drawing, the coulomb amount provided to the substrate Sb from the time q to the time t is equivalent to the coulomb amount when each of the platings is performed for the period from the time q to the time q' with the current value of the value X(1−Y), for the period from the time q' to the time r with the current value of the value W, for the period t3 with the current value of the value $X(1-Y)^{\wedge 2}$, and for the period t4 with the current value of a value X(1−Y)(1+Z).

As described above, in the example illustrated in FIG. 6, the value X(1−Y) is exceeding the limiting current value at the time point of the time q. In view of this, instead of the plating for the period t1 with the current value of the value X(1−Y), the plating is performed for the period t3 with the value $X(1-Y)^{\wedge 2}$ smaller than the value X(1−Y), and thereafter, the plating is performed for the period t4 with the value X(1−Y)(1+Z) greater than the value X(1−Y). This can continue the plating process without the current value exceeding the limiting current value.

In the example illustrated in FIG. 6, the period t3 and the period t4 are set as described above. This can obtain the product substrates having the close quality while maintaining the identical plating film thickness for the identical plating period, compare with the case where the plating is performed for the period t1 with the current value of the value X(1−Y).

In the example in the drawing, the value X(1+Z) is less than the limiting current value. When the value X(1+Z) is equal to or more than the limiting current value, instead of the plating for the period t2 with the current value of the value X(1+Z), the plating may be performed for a predetermined period with a value (for example, the value X(1+Z)(1−Y)) smaller than the value X(1+Z), and thereafter the plating may be performed for a predetermined period with a value (for example, a value $X(1+Z)^{\wedge 2}$) greater than the value X(1+Z). In this case, respective plating periods are set so that the coulomb amount provided to the substrate Sb when the plating is performed for a predetermined period (the period t2) with the current value of the value X(1+Y) and the coulomb amount provided to the substrate Sb from the time t to the time T* are identical.

In the first embodiment, s and T* related to the time and W, X, Y, and Z related to the current are preliminarily determined values. The period from s to s' and the period from q to q' are values determined by a measurement result of the voltage value by the voltage measuring unit 42. The period from s' to q and the period from q' to r may be preliminarily determined or may be determined corresponding to the measurement result of the voltage value by the voltage measuring unit 42. The periods t1, t2, t3, and t4 are values calculated from the above-described conditions and calculation from the measurement result of the voltage value by the voltage measuring unit 42 by the current control unit 40.

The first embodiment is typically the plating method to avoid the plating abnormality from occurring when the limiting current value decreases for any reason and the plating is continued with the current value X, in a plating method to set the current value X assuming that the current value does not exceed the limiting current value as in FIG. 4. However, it is not exclude the plating taking a current waveform as in FIG. 5 and FIG. 6 as usual terms, by setting the current value X to a value assumed to exceed the limiting current value.

Second Embodiment

The following describes an estimating method of the limiting current density according to a second embodiment. The plating apparatus and the substrate holder 11 that execute the estimating method of the limiting current density according to the second embodiment are similar to those illustrated in FIG. 1 to FIG. 3, thus omitting the description.

Figure 7:
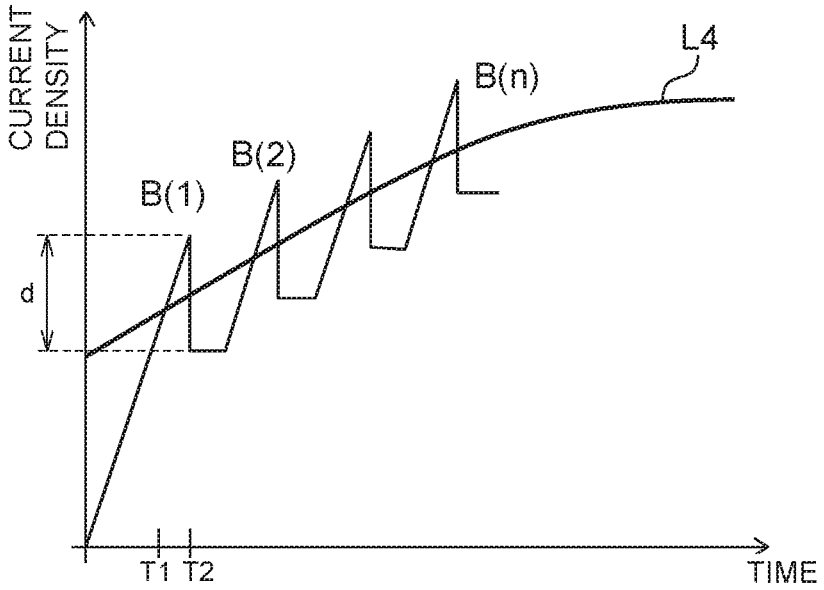
FIG. 7 is a graph illustrating an exemplary current control in a plating apparatus that executes an estimating method of a limiting current density according to a second embodiment.

FIG. 7 is a graph illustrating an exemplary current control in the plating apparatus that executes the estimating method of the limiting current density according to the second embodiment. In the graph in the drawing, the horizontal axis indicates a time, and the vertical axis indicates a current density. In the graph in the drawing, for convenience, a curved line L4 that indicates a virtual limiting current density is noted. As illustrated in the drawing, the current control unit 40 of this plating apparatus controls the plating power supply 30 to continuously increase the current density in proportion to the time from the time point of a time 0. A gradient (an increased amount of the current density per unit time) of the graph at this time is defined as δ.

In the second embodiment, similarly to the first embodiment, preliminarily in the test, a degree of increase in the voltage value for a predetermined period in a case where an abnormality occurs on the substrate Sb when being plated by increasing the current density (a case where the current density has reached the limiting current density) has been obtained. In the second embodiment, similarly to the first embodiment, for example, it is assumed that it has been proved that, in the test, in the case where the current density has reached the limiting current density, the voltage value has changed by a predetermined value 0.3 V (a predetermined value) or more within 15 seconds (the predetermined period) from a change of the current value such that the current control unit 40 controls the plating power supply 30.

The voltage measuring unit 42 of the current control unit 40 constantly measures the voltage value applied to the substrate Sb at the same time as a start of increase in the current density. When the current density gradually increases, the current density reaches the limiting current density at the time point of a time T1. When the current density has reached the limiting current density, the voltage value rapidly increases. The determining unit 44 constantly obtains the voltage value from the voltage measuring unit 42. The determining unit 44 determines that the current density is equal to or more than the limiting current density when the voltage value has increased by a predetermined value within a predetermined period. More specifically, the determining unit 44 determines whether a difference between the obtained voltage value and the minimum voltage value among the voltage values from the obtaining time point up to 15 seconds prior to the obtaining time point is 0.3 V or more or not every time that the determining unit 44 obtains the voltage value from the voltage measuring unit 42. At this time, a period from the time obtaining the minimum voltage value to the time obtaining the latest voltage value, that is, a period U(1) taken for the voltage value to increase by 0.3 V is recorded in recording means (not illustrated) of the current control unit 40.

In the example in the drawing, at a time T2, the determining unit 44 determines that the current density is equal to or more than the limiting current density. At this time, the current control unit 40 reduces the current density by a predetermined value. This decreased amount d can be expressed in, for example, δ×U(1)+a (a is a preliminarily determined value).

When the current density at the time T2 when the current density has been determined to be equal to or more than the limiting current density by the determining unit 44 is defined as a current density B(1), in this embodiment, the current control unit 40 estimates B(1)−δ×U(1) as an estimated limiting current density R(1) at the time T2. In other words, a value of the current density at a time when the voltage value smaller by 0.3 V than the voltage value obtained at the time T2 has been obtained is defined as the estimated limiting current density R(1) at the time T2.

As illustrated in the drawing, after the current density is reduced by the decreased amount d at the time T2, the current density is maintained for a predetermined period. This predetermined period is a period required for the voltage value to sufficiently decrease and preliminarily set. Alternatively, the current control unit 40 may maintain the current density until the voltage value obtained by the voltage measuring unit 42 has sufficiently decreased. After a lapse of the predetermined period, the current control unit 40 increases the current density with gradient 6 again, thus repeating a similar process. This can obtain a plurality of values of the estimated limiting current density R(n) with time.

In the current control illustrated in FIG. 7, the plurality of values of the estimated limiting current density R(n) with time are obtained. In other words, a graph where the horizontal axis is a time and the vertical axis is an estimated limiting current density is obtained. However, when the substrate Sb is actually plated, a current control different from the current control illustrated in FIG. 7 may be performed. In view of this, the graph of the estimated limiting current density taking the time as the horizontal axis obtained in the method of this embodiment is preferably transformed into a graph of the estimated limiting current density taking an electrolysis amount (or a plating film thickness) as the horizontal axis. Specifically, an area between the graph and the horizontal axis illustrated in FIG. 7 (that is, an integral value of the graph illustrated in FIG. 7) is equivalent to the electrolysis amount. Thus, the electrolysis amount when each estimated limiting current density R(n) is obtained from the graph illustrated in FIG. 7 can be read. In view of this, the graph of the estimated limiting current density obtained from the graph illustrated in FIG. 7 can be transformed into a graph taking the electrolysis amount as the horizontal axis and the estimated limiting current density as the vertical axis. This can plate the substrate Sb with the current control different from the current control illustrated in FIG. 7 in accordance with the estimated limiting current density corresponding to the electrolysis amount. The substrate may be plated with the current control illustrated in FIG. 7. In this case, the substrate can be plated with the current density close to the limiting current density, thus improving a plating rate.

The embodiments of the present invention have been described above in order to facilitate understanding of the present invention without limiting the present invention. The present invention can be changed or improved without departing from the gist thereof, and of course, the equivalents of the present invention are included in the present invention. It is possible to arbitrarily combine or omit respective constituent elements according to claims and description in a range in which at least a part of the above-described problems can be solved, or a range in which at least a part of the effects can be exhibited.

The following describes some aspects disclosed by this description.

According to a first aspect, a plating method is provided. The plating method increases current value from a predetermined current value to a first current value, and plates the substrate for a first predetermined period with the first current value when a first current density corresponding to the first current value is lower than a limiting current density. This plating method includes a step of measuring a voltage value applied to the substrate, and a determination step of, when the current value is increased from the predetermined current value to the first current value, determining whether the first current density is equal to or more than the limiting current density or not based on an amount of change in the voltage value.

It has been found that, when the plating is performed with the current density applied to the substrate reaching the limiting current density, the value of the voltage applied to the substrate rapidly increases. With the first aspect, it can be determined whether the first current density is equal to or more than the limiting current density or not by looking the amount of change in the voltage value when the current value is increased from the predetermined current value to the first current value. This can understand whether the current density is equal to or more than the limiting current density or not during the plating.

According to a second aspect, in the plating method of the first aspect, the determination step determines that the first current density is equal to or more than the limiting current density when the voltage value has increased by a predetermined value within a predetermined period after the current value has increased from the predetermined current value to the first current value.

As described above, when the plating is performed with the current density applied to the substrate reaching the limiting current density, the value of the voltage applied to the substrate rapidly increases. With the second aspect, confirming that the voltage value has increased by the predetermined value can determine that the first current density is equal to or more than the limiting current density.

According to a third aspect, in the plating method of the first aspect or the second aspect, a plating step including, when the first current density is determined to be equal to or more than the limiting current density, performing plating for a second predetermined period with a second current value corresponding to a second current density lower than the first current density, and subsequently performing the plating for a third predetermined period with a third current value corresponding to a third current density higher than the first current density is included. A coulomb amount provided to the substrate when the plating is performed for the first predetermined period with the first current value and a coulomb amount provided to the substrate in the plating step are identical.

With the third aspect, the product substrate close to that in the case where the plating is performed for the first predetermined period with the first current value can be obtained.

According to a fourth aspect, in the plating method of the third aspect, a step of, when the first current density is determined to be equal to or more than the limiting current density, reducing the current value to the predetermined current value before the plating step and maintaining the current value for a fourth predetermined period is included.

With the fourth aspect, the voltage value increased when the current value has increased to the first current value can be decreased. Eventually, the increased amount of the voltage value when the current value is increased from the predetermined current value to the second current value can be appropriately obtained.

According to a fifth aspect, in the plating method of the fourth aspect, the fourth predetermined period is a period required for the voltage value applied to the substrate to return to a voltage value applied to the substrate immediately before the current value increases to the first current value.

With the fifth aspect, the voltage value can be returned to the voltage value applied to the substrate immediately before the current value increases to the first current value. Thus, the increased amount of the voltage value when the current value is increased from the predetermined current value to the second current value can be further appropriately obtained.

According to a sixth aspect, in the plating method of any of the first aspect to the fifth aspect, a step of, when the first current density is determined to be equal to or more than the limiting current density, notifying a fact thereof is included.

With the sixth aspect, when the first current density has reached the limiting current density, the user or the like can be notified of a fact thereof. This allows the user or the like to determine whether to continue or stop the plating and the like.

According to a seventh aspect, a plating apparatus that plates a substrate by increasing a current value from a predetermined current value to a first current value is provided. This plating apparatus includes a plating bath configured to house a plating solution, a power supply that applies a current to the substrate, and a current control unit that controls the current to the substrate. The current control unit includes a voltage measuring unit that measures a voltage value applied to the substrate, and a determining unit that, when the current value is increased from the predetermined current value to the first current value, determines whether a first current density corresponding to the first current value is equal to or more than a limiting current density or not based on an amount of change in the voltage value. The current control unit controls the power supply to apply the current to the substrate for a first predetermined period with the first current value when the first current density is lower than the limiting current density.

It has been found that, when the plating is performed with the current density applied to the substrate reaching the limiting current density, the value of the voltage applied to the substrate rapidly increases. With the seventh aspect, it can be determined whether the first current density is equal to or more than the limiting current density or not by looking the amount of change in the voltage value when the current value is increased from the predetermined current value to the first current value. This can understand whether the current density is equal to or more than the limiting current density or not during the plating.

According to an eighth aspect, in the plating apparatus of the seventh aspect, the determining unit determines that the first current density is equal to or more than the limiting current density when the voltage value has increased by a predetermined value within a predetermined period after the current value has increased from the predetermined current value to the first current value.

As described above, when the plating is performed with the current density applied to the substrate reaching the limiting current density, the value of the voltage applied to the substrate rapidly increases. With the eighth aspect, confirming that the voltage value has increased by the predetermined value can determine that the first current density is equal to or more than the limiting current density.

According to a ninth aspect, in the plating apparatus of the seventh aspect or the eighth aspect, when the first current density is determined to be equal to or more than the limiting current density, the current control unit controls the power supply to apply the current to the substrate for a second predetermined period with a second current value corresponding to a second current density lower than the first current density, and subsequently apply the current to the substrate for a third predetermined period with a third current value corresponding to a third current density higher than the first current density. A coulomb amount provided to the substrate when plating is performed for the first predetermined period with the first current value and a coulomb amount provided to the substrate when the first current density is determined to be equal to or more than the limiting current density are identical.

With the ninth aspect, the product substrate close to that in the case where the plating is performed for the first predetermined period with the first current value can be obtained.

According to a tenth aspect, in the plating apparatus of the ninth aspect, when the first current density is determined to be equal to or more than the limiting current density, the current control unit controls the power supply to reduce the current value to the predetermined current density and maintain the current value for a fourth predetermined period before applying the current to the substrate with the second current density and the third current density.

With the tenth aspect, the voltage value increased when the current value has increased to the first current value can be decreased. Eventually, the increased amount of the voltage value when the current value is increased from the predetermined current value to the second current value can be appropriately obtained.

According to an eleventh aspect, in the plating apparatus of the tenth aspect, the fourth predetermined period is a period required for the voltage value applied to the substrate to return to a voltage value applied to the substrate immediately before the current value increases to the first current value.

With the eleventh aspect, the voltage value can be returned to the voltage value applied to the substrate immediately before the current value increases to the first current value. Thus, the increased amount of the voltage value when the current value is increased from the predetermined current value to the second current value can be further appropriately obtained.

According to a twelfth aspect, in the plating apparatus of any of the seventh aspect to the eleventh aspect, a notification unit that, when the first current density is determined to be equal to or more than the limiting current density, notifies a fact thereof is included.

With the twelfth aspect, when the first current density has reached the limiting current density, the user or the like can be notified of a fact thereof. This allows the user or the like to determine whether to continue or stop the plating and the like.

According to a thirteenth aspect, a method for estimating a limiting current density in a plating apparatus that plates a substrate is provided. This method includes a step of increasing a current density of a current applied to the substrate, a step of measuring a voltage value applied to the substrate, and a step of, when the voltage value has increased by a predetermined value within a predetermined period, determining that the current density is equal to or more than the limiting current density.

It has been found that, when the plating is performed with the current density applied to the substrate reaching the limiting current density, the value of the voltage applied to the substrate rapidly increases. With the thirteenth aspect, it can be determined whether the first current density is equal to or more than the limiting current density or not by looking the amount of change in the voltage value when the current value is increased from the predetermined current value to the first current value. This can understand whether the current density is equal to or more than the limiting current density or not, and eventually can estimate an approximate value of the limiting current density.

According to a fourteenth aspect, in the method of the thirteenth aspect, the step of increasing the current density includes a step of continuously increasing the current density in proportion to a time.

With the fourteenth aspect, the current density is gradually increased. Thus, a time when the increase in the voltage value is confirmed can be estimated as a timing when the current density has reached the limiting current density.

According to a fifteenth aspect, in the method of the thirteenth aspect or the fourteenth aspect, when the current density is determined to be equal to or more than the limiting current density in the determination step, a current density at a time point before the predetermined period from the determination is estimated as a limiting current density in the determination.

With the fifteenth aspect, the timing when the current density has reached the limiting current density can be estimated. As a result, the current density at this timing can be estimated as the limiting current density.

According to a sixteenth aspect, in the method of any of the thirteenth aspect to the fifteenth aspect, a step of, when the current density is determined to be equal to or more than the limiting current density in the determination step, reducing the current density is included.

With the sixteenth aspect, the voltage value increased when the current density has reached the limiting current density or more can be decreased. Eventually, when the limiting current density is estimated by continuously increasing the current density, the increased amount of the voltage value when the current density is increased can be appropriately obtained.

REFERENCE SIGNS LIST

11 . . . substrate holder
30 . . . power supply
40 . . . current control unit
42 . . . voltage measuring unit
43 . . . notification unit
44 . . . determining unit

What is claimed is:

1. A plating method comprising:

increasing a current value from a predetermined current value to a first current value, and plating a substrate for a first predetermined period with the first current value when a first current density corresponding to the first current value is lower than a limiting current density;

measuring a voltage value applied to the substrate; and when the current value is increased from the predetermined current value to the first current value, determining whether the first current density is equal to or more than the limiting current density or not based on an amount of change in the voltage value.

2. The plating method according to claim 1, wherein the determining includes determining that the first current density is equal to or more than the limiting current density when the voltage value has increased by a predetermined value within a predetermined period after the current value has increased from the predetermined current value to the first current value.

3. The plating method according to claim 1, comprising performing a specific plating including, when the first current density is determined to be equal to or more than the limiting current density, performing plating for a second predetermined period with a second current value corresponding to a second current density lower than the first current density, and subsequently performing the plating for a third predetermined period with a third current value corresponding to a third current density higher than the first current density, wherein a coulomb amount provided to the substrate when the plating is performed for the first predetermined period with the first current value and a coulomb amount provided to the substrate in the specific plating are identical.

4. The plating method according to claim 3, comprising when the first current density is determined to be equal to or more than the limiting current density, reducing the current value to the predetermined current value before the specific plating and maintaining the current value for a fourth predetermined period.

5. The plating method according to claim 4, wherein the fourth predetermined period is a period required for the voltage value applied to the substrate to return to a voltage value applied to the substrate immediately before the current value increases to the first current value.

6. The plating method according to claim 1, comprising when the first current density is determined to be equal to or more than the limiting current density, notifying a fact thereof.

* * * * *